US005308529A

United States Patent [19]

Kaiserman et al.

[11] Patent Number: 5,308,529

[45] Date of Patent: May 3, 1994

[54] SYSTEM FOR ENHANCING RELEASE OF ACIDS FROM ANHYDRIDE PRECURSORS USING ESTERASE CATALYSTS

[75] Inventors: Howard B. Kaiserman, Cliffside Park; Michael T. Tallman, Edgewater, both of N.J.

[73] Assignee: Lever Brothers Company, Division of Conopco, Inc., New York, N.Y.

[21] Appl. No.: 939,259

[22] Filed: Sep. 2, 1992

[51] Int. Cl.[5] ..... C11D 1/00

[52] U.S. Cl. ..... 252/174.12; 252/89.1; 252/142; 252/DIG. 12; 8/137

[58] Field of Search ..... 252/172.12, DIG. 12; 435/198

[56] References Cited

U.S. PATENT DOCUMENTS

| | | | |
|---|---|---|---|
| 4,810,414 | 3/1989 | Huge-Jensen et al. | 257/174.12 |
| 4,959,179 | 9/1990 | Aronson et al. | 252/174.12 |
| 5,069,809 | 12/1991 | Lagerwaard et al. | 252/174.12 |

OTHER PUBLICATIONS

Pieroni et al. Eur. J. Biochem. vol. 193 pp. 249–253 (1990).

Lui et al. Agr. Biol. Chem. 37(11) pp. 2493–2499 (1973).

Omar et al. Agr. Biol. Chem. 51 (8) pp. 2153–2159 (1987).

Lui et al. Agr. Biol. Chem. 37(6) pp. 1349–1355 (1973).

*Primary Examiner*—Robert A. Wax

*Assistant Examiner*—D. B. Schmickel

*Attorney, Agent, or Firm*—Ronald A. Koatz

[57] ABSTRACT

The present invention provides a system for releasing an acid from acid precursors using an esterase enzyme (i.e., enzyme having esterase activity) as the activator.

6 Claims, No Drawings

SYSTEM FOR ENHANCING RELEASE OF ACIDS FROM ANHYDRIDE PRECURSORS USING ESTERASE CATALYSTS

BACKGROUND OF THE INVENTION

The present invention relates to a system for enhancing release of acids into a wash from anhydride precursors found in the wash (e.g., an acyl anhydride) using esterases as activators for the anhydride precursors. In particular, acid release is enhanced under relatively neutral conditions (i.e., about pH 7).

Acids, e.g., carboxylic acids, have long been employed in numerous cleaning applications including the washing and prewashing of fabrics as well as in other applications such as hard surface cleaning. In these applications, the acids are used, for example, for buffering and enzyme stabilization.

Although acids are formed from the hydrolysis of anhydrides, this reaction is generally very slow under neutral conditions (i.e., about pH 7) and can be accelerated only by using harsher conditions such as very low (e.g., below pH 5) or very high (e.g., above pH 10) pH conditions.

In a related application, U.S. Ser. No. 841,395 to Kaiserman et al., applicants disclosed the use of enzyme activators to release bleach from bleach precursors. There was no teaching in that application regarding production of acids from anhydride precursors.

Accordingly, there is a need in the art for accelerating production of acids from anhydride precursors.

Unexpectedly, applicants have discovered a system whereby acids are released more quickly from acid precursors (i.e., anhydrides) using esterase enzymes (i.e., any enzyme having esterase activity). The acceleration of acid formation can be noted at all pH ranges relative to not using esterase at all, but is especially striking in that it allows acid to be formed from anhydride even at neutral pH ranges (i.e., pH 7) where it was not previously believed that acid release from these acid precursors was achievable. That is formation of the acid from anhydrides at neutral pH was previously believed nonexistent or negligible at best.

The present system may be used in liquid or powder detergent systems such as are well known to those skilled in the art.

BRIEF SUMMARY OF THE INVENTION

The subject invention provides a system for releasing acids from acid precursors using esterase enzymes. The use of the esterase enzymes allows the enzymes to function as activators of the acid source as well as providing the performance benefit associated with the use of the enzymes. The system further allows an acid to be formed under relatively mild pH conditions.

In particular, the acid release system comprises (1) an acid precursor (i.e., anhydride); and (2) an esterase enzyme (i.e., enzyme having esterase activity) for hydrolyzing the acid precursor in order to form the acid compound.

DETAILED DESCRIPTION OF THE INVENTION

The present invention relates to a system for releasing acid from acid precursor (i.e., anhydride ester substrate) using an esterase enzyme. Thus, the acid is formed under relatively mild conditions. In addition the enzyme has a dual activation/performance function and no additional activators are required.

The necessary components for the enzymatic (i.e., with an esterase) hydrolysis system of the invention are simply the acid precursor (i.e., anhydride) and the esterase. Additional components which may be used in the system of the invention are adjuncts which may be of importance in a commercial product or process employing the invention.

Characteristics and preferred examples of the essential components of the enzymatic hydrolysis system, including the acid precursor (i.e., anhydride) and the esterase, are discussed in greater detail below, followed by a discussion of other adjuncts which can be used together with the hydrolysis system and a number of examples which follow.

ESTER SUBSTRATE (ACID PRECURSOR)

The acid precursor (i.e., the anhydride ester substrate) of the invention can be any diacyl anhydride such as may be known to those skilled in the art and which is susceptible to enzymatic cleavage by the esterases of the invention.

More specifically, the substrate is a diacyl anhydride having the following structure:

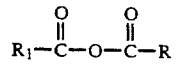

wherein R or $R_1$ may be the same or different and may be saturated or unsaturated alkyl having 1 to 20 carbons, an aryl group (e.g., phenyl group), or an alkaryl group (e.g., substituted phenyl group).

Most preferably, R and $R_1$ are phenyl groups and the component is a benzoic anhydride derivative.

ENZYME

In principal any esterase which reacts with the ester substrate to release the acid may be used. For example, the enzyme may be a lipolytic enzyme.

The lipolytic enzyme used may be either a fungal lipase producible by Humicola lanuginosa and Thermomyces lanuginosus, or a bacterial lipase which show a positive immunological cross-reaction with the antibody of the lipase produced by the microorganism Chromobacter viscosum var lipolyticum NRRL B-3673. This microorganism has been described in Dutch patent specification 154 269 of Toyo Jozo Kabushiki Kaisha and has been deposited with the Fermentation Research Institute, Agency of Industrial Science and Technology, Ministry of International Trade and Industry, Tokyo, Japan and added to the permanent collection under nr. KO Hatsu Ken Kin Ki 137 and is available to the public at the United States Department of Agriculture, Agricultural Research Service, Northern Utilization and Development Division at Peoria, Ill., USA, under the nr. NRRL B-3673. The lipase produced by this microorganism is commercially available from Toyo Jozo Co., Tagata, Japan, hereafter referred to as "TJ lipase". These bacterial lipases should show a positive immunological cross-reaction with the TJ lipase antibody, using the standard and well-known immunodiffusion procedure according to Ouchterlony (Acta. Med. Scan., 133, pages 76–79 (1950).

The preparation of the antiserum is carried out as follows:

Equal volumes of 0.1 mg/ml antigen and of Freund's adjuvant (complete or incomplete) are mixed until an emulsion is obtained. Two female rabbits are injected with 2 ml samples of the emulsion according to the following scheme:

day 0: antigen in complete Freund's adjuvant
day 4: antigen in complete Freund's adjuvant
day 32: antigen in incomplete Freund's adjuvant
day 60: booster of antigen in incomplete Freund's adjuvant The serum containing the required antibody is prepared by centrifugation of clotted blood, taken on day 67.

The titre of the anti-TJ-lipase antiserum is determined by the inspection of precipitation of serial dilutions of antigen and antiserum according to the Ouchterlony procedure. A $2^5$ dilution of antiserum was the dilution that still gave a visible precipitation with an antigen concentration of 0.1 mg/ml.

All bacterial lipases showing a positive immunological cross-reaction with the TJ-lipase antibody as hereabove described are lipases suitable in this embodiment of the invention. Typical examples thereof are the lipase ex Pseudomonas fluorescens IAM 1057 available from Amano Pharmaceutical Co., Nagoya, Japan, under the trade name Amano-P lipase, the lipase ex Pseudomonas fragi FERM P 1339 (available under the trade name Amano-B), the lipase ex Pseudomonas nitroreducens var. lipolyticum FERM P 1338, the lipase ex Pseudomonas sp. available under the trade name Amano CES, the lipase ex Pseudomonas cepacia lipases ex Chrombacter viscosum. e.g., Chrombacter viscosum var. lipolyticum NRRL B-3673, commercially available from Toyo Jozo Co., Tagata, Japan; and further Chrombacter viscosum lipases from U.S. Biochemical Corp. USA and Diosynth Co., The Netherlands, and lipases ex Pseudomonas gladioli.

An example of a fungal lipase as defined above is the lipase ex Humicola lanuginosa, available from Amano under the trade name Amano CE; the lipase ex Humicola lanuginosa as described in the aforesaid European Patent Application 0258,068 (NOVO), as well as the lipase obtained by cloning the gene from Humicola lanuginosa and expressing this gene in Aspergillus oryzae, commercially available from NOVO Industri A/S under the trade name "Lipolase". This lipolase is a preferred lipase for use in the present invention.

While various specific lipase enzymes have been described above, it is to be understood that any lipase which can confer the desired lipolytic activity to the composition may be used and the invention is not intended to be limited in any way by specific choice of lipase enzyme.

The lipases of this embodiment of the invention are included in the liquid detergent composition in such an amount that the final composition has a lipolytic enzyme activity of from 100 to 0.005 LU/ml in the wash cycle, preferably 25 to 0.05 LU/ml when the formulation is dosed at a level of about 2 gm/liter.

A lipase Unit (LU) is that amount of lipase which produces 1$\mu$mol of titratable fatty acid per minute in a pH stat under the following conditions: temperature 30° C.; pH=9.0; substrate is an emulsion of 3.3 wt. % of olive oil and 3.3% gum arabic, in the presence of 13 mmol/$Ca^{2+}$ and 20 mmol/NaCl in 5 mmol/ Tris-buffer.

Naturally, mixtures of the above lipases can be used. The lipases can be used in their non-purified form or in a purified form, e.g., purified with the aid of well-known absorption methods, such as phenyl sepharose absorption techniques.

The esterase may also be a protease enzyme. Proteases of the invention can be of vegetable, animal or microorganism origin. Preferably, it is of the latter origin, which includes yeasts, fungi, molds and bacteria. Particularly preferred are bacterial subtilisin type proteases, obtained from e.g., particular strains of B. subtilis and B. Licheniformis. Examples of suitable commercially available proteases are Alcalase, Savinase, Esperase, all of NOVO Industri a/S; Maxatase and Maxacal of Gist-Brocades; Kazusase of Showa Denko; BPN and BPN, proteases and so on. The amount of proteolytic enzyme, included in the composition, ranges from 0.1–50 GU/mg. based on the final composition. Naturally, mixtures of different proteolytic enzymes may be used in combination with the lipase in this embodiment of the invention.

A GU is a glycine unit, which is the amount of proteolytic enzyme which under standard incubation conditions produces an amount of terminal $NH_2$ groups equivalent to 1 microgramme/ml of glycine.

The esterase may also be a mammalian esterase such as porcine liver esterase or rabbit liver esterase or it may be a eukaryotic esterase such as wheat germ type I esterase. The amount of esterase used should be such that final composition has an esterase enzyme activity of from 100 to 0.005 EU/ml in the wash cycle, preferably 25 to 0.05 EU/ml when the formulation is dosed at a level of about 2 gm/liter.

Esterase unit is defined as the amount of enzyme that hydrolyzes 1.0 $\mu$mol of p-nitrophenyl valerate per minute at 30 deg. centigrade in a solution containing 100 mM Tris-HCl, 0.178 mM $CaCl_2$, 0.089 mM $MgCl_2$, 2.0 mM SDS, and 0.00128 mM p-nitrophenyl valerate at pH 8.

THE ACID RELEASE SYSTEM REACTION

The invention is based on the interaction of the acid substrate (i.e., preferably a diacyl anhydride) and an esterase (e.g. a lipase enzyme).

It should be noted that the system can be used at a variety of pH levels. Thus, the system would be useful in normally basic aqueous solutions, in relatively neutral solutions and even in acidic solutions. The use of a buffer is possible but not necessary with the system.

However, the system is particularly beneficial in that it can be used to enhance acid release even at neutral pH range (i.e., at pH of about 6 to about 8, preferably a pH of about 7) whereas acid release from anhydride in the absence of the esterase is either non-existent or negligible.

The acid release system is also adapted for a wide variety of temperatures as long as the temperatures do not denature the enzyme. Accordingly, the system of the invention may be employed in low temperature wash conditions as well as high temperature conditions.

An example of the acid release system of the invention (using a diacyl anhydride as substrate) is set forth schematically below.

$$\text{DIACYL ANHYDRIDE} \xrightarrow[H_2O]{\text{ESTERASE}} \text{ACID}$$

In one embodiment, the acid release system is shown as set forth below:

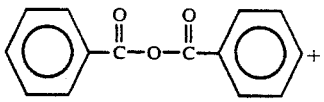

Benzoic Anhydride

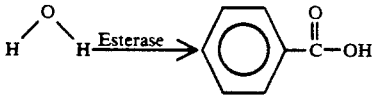

Water Benzoic Acid (2)

OTHER ADJUNCTS

The use of emulsifiers or surfactants is generally desirable, for example, to promote detergency and other characteristics desirable in detergency products. The emulsifying agents are not considered essential to this invention.

Nonionic surfactants which may be used in the system of the invention include linear ethoxylated alcohols such as those sold by Shell Chemical Company under the brand name NEODOL TM. Other nonionic surfactants include various linear ethoxylated alcohols with an average length of from about 6 to 16 carbon atoms and averaging about 2 to 20 moles of ethylene oxide per mole of alcohol; linear and branched primary and secondary ethoxylated, propoxylated alcohols with an average length of about 6 to 16 carbon atoms and averaging 0 to 10 moles of ethylene oxide and about 1 to 10 moles of propylene oxide per mole of alcohol; linear and branched alkylphenoxy (polyethoxy) alcohols, otherwise known as ethoxylated alkylphenols with an average chain length of 8 to 16 carbon atoms and averaging 1.5 to 30 moles of ethylene oxide per mole of alcohol; and mixtures thereof.

Additional nonionic surfactants include certain block copolymers of propylene oxide and ethylene oxide, block polymers propylene oxide and ethylene oxide with propoxylated ethylene diamine, and semi-polar nonionic surfactants such as amine oxides, phosphate oxides, sulfoxides and their ethoxylated derivatives.

Anionic surfactants may also be employed. Examples of such anionic surfactants include alkali metal and alkaline earth metal salts of $C_4$ to $C_{18}$ fatty acids and resin acids, linear and branched alkyl benzene sulfonates, alkyl sulfates, alkyl ether sulfates, alkane sulfonates, olefin sulfonates and hydroxyalkane sulfonates.

Suitable cationic surfactants include the quaternary ammonium compounds in which typically one of the groups linked to the nitrogen atoms is a $C_6$ to $C_{19}$ alkyl group and the other three groups are short chained alkyl groups which may bear inert substituents such as phenyl groups.

Further, suitable amphoteric and zwitterionic surfactants which may contain an anionic water-solubilizing group, a cationic group, and a hydrophobic organic group, include amino carboxylic acids and their salts, amino di-carboxylic acids and their salts, alkybetainoic, alkyl aminopropylbetaines, sulfobetaines, alkyl imidazolinium derivatives, certain quaternary ammonium compounds, and certain tertiary sulfonium compounds.

The surfactant of the invention should be used in an amount of from 2 to 85% by weight of the detergent composition.

Other exemplary emulsifiers include water soluble or dispersible polymers such as polyvinyl alcohol (PVA) polyvinylpyrrolidone (PVP), methylhydroxypropylcellulose (MHPC) etc., as well as bile and other natural emulsifiers.

Additional adjuncts of a wide variety may be considered for use in combination with the acid release system of the present invention, depending upon the specific application contemplated. For example, as noted above, the release system may be employed or included within a wide variety of cleaning applications or formulations such as pre-wash products (which are often in liquid form) or various hard surface cleaners.

Builders which can be used according to the invention include any of the many builders used in the amounts specified for structured or unstructured liquids (if the composition is liquid rather than powder) as described in U.S. Pat. No. 5,071,586 to Kaiserman et al, which is hereby incorporated by reference into the subject application. By structured liquid composition is meant a composition in which at least some of the detergent active forms a structured phase capable of suspending a solid particulate material. Greater details are provided in the aforementioned Kaiserman patent.

Additional adjuncts may include fragrances, dyes, stabilizers, buffers, etc. Stabilizers may be included to achieve a number of purposes. For example, the stabilizers may be directed toward establishing and maintaining effectiveness of the enzymes for original formulation components or even intermediate products existing after the formulation is placed in an aqueous solution. Since enzymes may be hindered in hydrolysis of the substrates because of heavy metals, organic compounds, etc., for example, suitable stabilizers which are generally known in the prior art may be employed to counter such effects and achieve maximum effectiveness of the enzymes within the formulations.

Examples of such enzyme stabilization systems include, but are not limited to calcium salts such as $CaCl_2$; short chain carboxylic acids or salts thereof, such as formic acid or propionic acid; polyethylene glycols, various polyols and specific hydrolyzed protein. Examples of suitable enzyme stabilizers are disclosed in U.S. Pat. No. 4,518,694; 4,908,150; and 4,011,169; all of which are incorporated herein by reference.

Buffering agents can also be utilized in the invention to maintain a desired alkaline pH level for the aqueous solutions. Buffering agents generally include all such materials which are well known to those skilled in the detergent art. In particular, buffering agents contemplated for use in the present invention include but are not limited to carbonates, phosphates, silicates, borates and hydroxides.

Another optional ingredient which may be used, particularly in structured liquids, is a deflocculating polymer such as is described in U.S. Pat. No. 5,071,586 to Kaiserman et al. or in U.S. Pat. No. 4,992,194 to Liberati et al., both of which are incorporated by reference into the subject application.

The following examples are intended to illustrate the invention further and are not intended to limit the claims in any way.

EXPERIMENTAL CONDITIONS

Standard reaction conditions for the rate determinations in Table 1 are as follows: 60% glycerol/water (w/w), 120 ppm hardness (2:1, Ca:Mg), 10 mM Triethanolamine adjusted to pH 7 with HCl, and 50 umol benzoic anhydride. All incubations were at −10 deg. centigrade for 5 mins. Benzoic acid produced was measured by HPLC via an internal standard (acenaphthylene).

It should be noted that the substrate may comprise anywhere from 0.01 to about 50%, preferably 0.01 to 25% of the detergent formula. This will of course vary depending on how much substrate activity is desired in the formulation.

EXAMPLE 1

Various enzymes with esterase activity (lipases, esterases, proteases) were tested against benzoic anhydride to determine the rate of formation of acid. As a control, the effect on benzoic anhydride when no esterase was present (i.e., heat killed lipolase) was also measured. The results are set forth in the Table below:

TABLE 1

Calculated Rates of Reaction for Various Enzymes with 50 μM Benzoic Anhydride at −10 deg. C.

| Enzyme | Rate (uMol Benzoic Acid prod./enzyme unit/min) | Assay |
|---|---|---|
| Heat Killed Lipolase | 0 | |
| Lipases | | |
| *Humicola languinosa* | 1.08 E-1 | lipase |
| Cutinase | 2.03 E-1 | lipase |
| *Aspergillus niger* | 9.27 E-3 | lipase |
| *Mucor miehei* | 2.52 E-3 | lipase |
| Biozyme PCM | 4.92 E-4 | lipase |
| *Candida cylindracea* | 1.52 E-4 | suppl. |
| *Chromobacterium viscosum* | 3.72 E-4 | suppl. |
| *Pseudomonas cepacia* | 2.18 E-3 | lipase |
| *Pseudomonas alcaligenes* SD2 | 7.00 E-3 | lipase |
| *Psuedomonas gladioli* | 2.70 E-2 | lipase. |
| Wheat ger | 3.60 E-4 | suppl. |
| Esterases | | |
| Porcine liver | 3.12 E-2 | suppl. |
| Rabbit liver | 3.34 E-2 | suppl. |
| Proteases | | |
| Savinase (Novo) | 7.77 E-3 | esterase |
| Papain | 6.2 E-3 | esterase |
| Maxapem (Ibis) | 5.60 E-3 | esterase |
| Durazym (Novo) | 4.08 E-3 | esterase |

Lipase units were defined previously in the text.
Esterase unit is defined as the amount of enzyme that hydrolyzes 1.0 umol of p-nitrophenyl valerate per minute at 30 deg. centigrade in a solution containing 100 mM Tris-HCl, 0.178 mM CaCl2, 0.089 mM MgCl2, 2.0 mM SDS, and 0.00128 mM p-nitrophenyl valerate at pH 8.
Suppl. = Units as defined by supplier As noted, no acid is produced when the esterase is heat killed, but acid is produced at varying rates depending on the esterase used.

In the examples above, the reaction was conducted at −10° C. and at pH 7 to slow down the effect of any hydrolysis from anhydride to acid which might occur at higher temperature or higher or lower (i.e., non-neutral) pH.

EXAMPLE 2

In order to show that the esterase is enhancing acid formation of the acid substrate (i.e., anhydride) even over broader pH ranges the following experiments were conducted.

A 50% acetronitrile/water system was used in the presence of 120 ppm water hardness solution (2:1 calcium:magnesium), 0.5 mM benzoic anhydride, and 25 ppm acenaphthylene internal standard. The following buffer systems were utilized:

For pH 5.00: 10 mM sodium citrate, adjusted to pH 5.00 with 0.1 citric acid.

For pH 10.0: 10 mM triethanolamine, adjusted to pH 10.0 with 0.1M hydrochloric acid.

All reactions were run on a 10 mL scale at room temperature for a total of 5.00 min. The benzoic anhydride and internal standard were added from a stock solution which was 1.0M benzoic anhydride and 25,000 pm acenaphthylene in 100% acetonitrile. A total of 5.0 μL of this stock was used (yielding a 1:2000 dilution) to make each reaction 0.5 mM benzoic anhydride and 25 ppm acenaphthylene. Benzoic acid produced was measured by HPLC (high pressure liquid chromatography) using the acenaphthylene internal standard as a reference.

The same HPLC analysis used in Example 1 was also used here and results are set forth below:

| ENZYME | pH OF REACTION | AMOUNT ENZYME USED | *REACTION OVER 5.00 MIN. |
|---|---|---|---|
| Genex 8397** | 5.00 | 60.0 EU/g. | 22.34% |
| | 10.0 | 3.04 EU/g. | 63.23% |
| Lipolase | 5.00 | 50.0 EU/g. | 33.30% |
| | 10.0 | 15.0 EU/g. | 86.06% |

Non-Enzymatic = Average Loss Between pHs 5.0 thru 10.0 < 5.0%
*Each value was done in duplicate, and background hydrolysis was substracted.
EU = esterase units
**Mutant of subtilisin BPN' having following mutations relative to wildtype:
MET50 → PHE
ASN76 → ASP
GLY169 → ALA
GLN206 → CYS
ASN218 → SER Since Genex 8397 is a protease, specifically a mutant of subtilisin BPN', and Lipolase is currently used in detergent products, the results indicate that the findings of Example 1 can be expanded over the pH region of 5.0 to 10.0, and are not limited to pH 7.0.

EXAMPLE 3

In order to show that any enzyme possessing esterase activity can hydrolyze anhydrides other than just benzoic anhydride, applicants used Genex 8397 proteaseas described in Example 2 on 5.0 mM phthalic anhydride substrate. The reaction was carried out at room temperature in a mixed solvent system (50% acetonitrile/water). The buffer and water hardness concentration were identical to that used for the benzoic anhydride systems.

The results are set for below:

| Enzyme | Amount Used (EU/g) | Rate (μmol BA/EU/min) |
|---|---|---|
| Genex 8397 | 60.77 | $3.03 \times 10^{-3}$ |

As can be seen, the invention clearly works on substrate other than benzoic anhydride alone.

We claim:

1. A detergent composition comprising:

(1) 2 to 85% by weight of a surfactant selected from the group consisting nonionic surfactants, anionic surfactants, cationic surfactants, amphoteric surfactants, zwitterionic surfactants and mixtures thereof; and (2) an acid release system for enhancing release of acids into said detergent composition comprising:

(a) an aromatic diacyl anhydride from which said acids are released; and (b) an esterase enzyme;

wherein the esterase enzyme reacts with the aromatic diacyl anhydride to enhance rate of release of the acids from the aromatic diacyl anhydride.

2. A composition according to claim 1, wherein the diacyl anhydride is benzoic anhydride.

3. A composition according to claim 1, wherein the esterase is a lipase enzyme.

4. A composition according to claim 3, wherein the lipase enzyme is obtained by cloning the gene from Humicola lanuginosa and expressing the gene in Aspergillus oryzae.

5. A composition according to claim 1, wherein the acid is released at pH 5 to 10.

6. A composition according to claim 5, wherein the acid is released at about pH 6 to pH about 8.

* * * * *